US009752270B2

(12) United States Patent
Chae et al.

(10) Patent No.: US 9,752,270 B2
(45) Date of Patent: Sep. 5, 2017

(54) WASHING MACHINE AND METHOD OF CONTROLLING THE SAME

(71) Applicant: LG ELECTRONICS INC., Seoul (KR)

(72) Inventors: Aekyung Chae, Seoul (KR); Sangwoo Lee, Seoul (KR); Youngho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/858,532

(22) Filed: Sep. 18, 2015

(65) Prior Publication Data

US 2016/0083892 A1 Mar. 24, 2016

(30) Foreign Application Priority Data

Sep. 19, 2014 (KR) ..... 10-2014-0125105

(51) Int. Cl.

| | |
|---|---|
| ***D06F 23/04*** | (2006.01) |
| ***D06F 29/00*** | (2006.01) |
| ***D06F 33/02*** | (2006.01) |
| ***D06F 37/12*** | (2006.01) |
| ***D06F 37/20*** | (2006.01) |

(Continued)

(52) U.S. Cl.

CPC ..... *D06F 39/008* (2013.01); *D06F 29/00* (2013.01); *D06F 37/203* (2013.01); *D06F 39/088* (2013.01); *D06F 39/14* (2013.01); *D06F 57/00* (2013.01); *D06F 73/00* (2013.01); *D06F 73/02* (2013.01); *D06F 23/04* (2013.01); *D06F 33/02* (2013.01); *D06F 37/12* (2013.01);

(Continued)

(58) Field of Classification Search

CPC ..... D06F 23/04; D06F 29/00; D06F 33/02; D06F 37/12; D06F 37/203; D06F 39/008; D06F 39/083; D06F 39/088; D06F 39/14; D06F 57/00; D06F 73/00; D06F 73/02; D06F 2204/065; D06F 2204/08; D06F 2222/00

USPC ..... 8/149.3, 158, 159; 68/5 C, 222, 240

See application file for complete search history.

(56) References Cited

U.S. PATENT DOCUMENTS

| | | | | |
|---|---|---|---|---|
| 2009/0172892 | A1* | 7/2009 | Oh | D06F 35/006 8/149.1 |
| 2011/0146004 | A1* | 6/2011 | Kim | D06F 33/02 8/137 |
| 2013/0185873 | A1* | 7/2013 | Bomar | D06F 39/008 8/137 |

FOREIGN PATENT DOCUMENTS

| | | |
|---|---|---|
| CN | 1880541 A | 12/2006 |
| CN | 102899850 A | 1/2013 |

(Continued)

OTHER PUBLICATIONS

Tobi et al., "JP 2011024990 A English Machine Translation.pdf", Feb. 10, 2011—Machine translation from Espacenet.com.*

*Primary Examiner* — Michael Barr
*Assistant Examiner* — Levon J Shahinian
(74) *Attorney, Agent, or Firm* — Dentons US LLP

(57) ABSTRACT

A washing machine and a method of controlling the same, which are capable of easily refreshing laundry, are disclosed. The washing machine includes an outer tub to contain wash water, an inner tub rotatably disposed in the outer tub, a hanger unit, which is disposed over the inner tub and on which laundry is hung, a steam generator disposed at the outer tub to heat the wash water so as to generate steam, and a drive unit rotating the inner tub to rotate the hanger unit (Continued)

and introduces the steam generated from the steam generator into the inner tub.

19 Claims, 6 Drawing Sheets

(51) Int. Cl.

| | |
|---|---|
| ***D06F 39/00*** | (2006.01) |
| ***D06F 39/08*** | (2006.01) |
| ***D06F 39/14*** | (2006.01) |
| ***D06F 57/00*** | (2006.01) |
| ***D06F 73/00*** | (2006.01) |
| ***D06F 73/02*** | (2006.01) |

(52) U.S. Cl.
CPC ..... *D06F 39/083* (2013.01); *D06F 2204/065* (2013.01); *D06F 2204/08* (2013.01); *D06F 2222/00* (2013.01)

(56) References Cited

FOREIGN PATENT DOCUMENTS

| | | | |
|---|---|---|---|
| JP | 2011024990 A | * | 2/2011 |
| JP | 2013-27416 A | | 2/2013 |

* cited by examiner

WASHING MACHINE AND METHOD OF CONTROLLING THE SAME

CROSS-REFERENCE TO RELATED APPLICATIONS

This application claims the benefit of Korean Patent Application Nos. 10-2014-0125105, filed on Sep. 19, 2014, which is hereby incorporated by reference for all purposes as if fully set forth herein.

BACKGROUND OF THE INVENTION

1. Field of the Invention

The present invention relates to a washing machine and a method of controlling the same, and more particularly to a washing machine and a method of controlling the same, which are capable of easily refreshing laundry.

2. Description of the Related Art

Washing machines generally refer to apparatuses which are constructed to perform a washing operation, a rinsing operation, a dehydration operation, and the like so as to remove contaminants from clothing and bedclothes (hereinafter, referred to as "laundry") through the interaction of water, detergent and mechanical actuation.

Washing machines are typically classified into agitator type washing machines, pulsator type washing machines and drum type washing machines.

The agitator type washing machine performs the washing operation in such a manner as to repeatedly rotate a washing rod, protruding upward from the center of a washing tub, clockwise and counterclockwise, and the pulsator type washing machine performs the washing operation in such a manner as to repeatedly rotate a disc-shaped rotating blade, provided at a lower portion of a washing tub, clockwise and counterclockwise so as to wash laundry using the frictional force between the water stream and the clothes. The drum type washing machine performs the washing operation in such a manner as to rotate a drum in which water, detergent and clothes are contained.

These washing machines usually require a refresh function for easily eliminating wrinkles and odors from laundry or for drying laundry, in addition to the general washing function.

SUMMARY OF THE INVENTION

Therefore, the present invention has been made in view of the above problems, and it is an object of the present invention to provide a washing machine and a method of controlling the same, which are capable of easily refreshing laundry.

Objects of the present inventions are not limited to the above-mentioned object, and other objects of the present invention will be clearly understood by those skilled in the art from the following disclosure.

In accordance with an aspect of the present invention, the above and other objects can be accomplished by the provision of a washing machine including an outer tub to contain wash water, an inner tub rotatably disposed in the outer tub, a hanger unit, which is disposed over the inner tub and on which laundry is hung, a steam generator disposed at the outer tub to heat the wash water so as to generate steam, and a drive unit rotating the inner tub to rotate the hanger unit and introduces the steam generated from the steam generator into the inner tub.

In accordance with another aspect of the present invention, there is provided a method of controlling a washing machine including an outer tub to contain wash water, an inner tub rotatably disposed in the outer tub, and a hanger unit disposed over the inner tub and on which laundry is hung, the method including heating wash water to generate steam in the outer tub, rotating the inner tub so as to rotate the hanger unit, and introduce the steam into the inner tub.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

The advantages, features and methods for achieving those in the embodiments may become apparent upon referring to the embodiments, described later in detail together with attached drawings. However, the embodiments are not limited to the embodiments disclosed hereinafter, but may be embodied in different modes. The embodiments are provided for completeness of disclosure and informing the scope to persons skilled in this field of art. The same reference numbers may refer to the same elements throughout the specification.

Hereinafter, a washing machine and a method of controlling the same, according to embodiments of the present invention, will be described with reference to the accompanying drawings.

Figure 1:
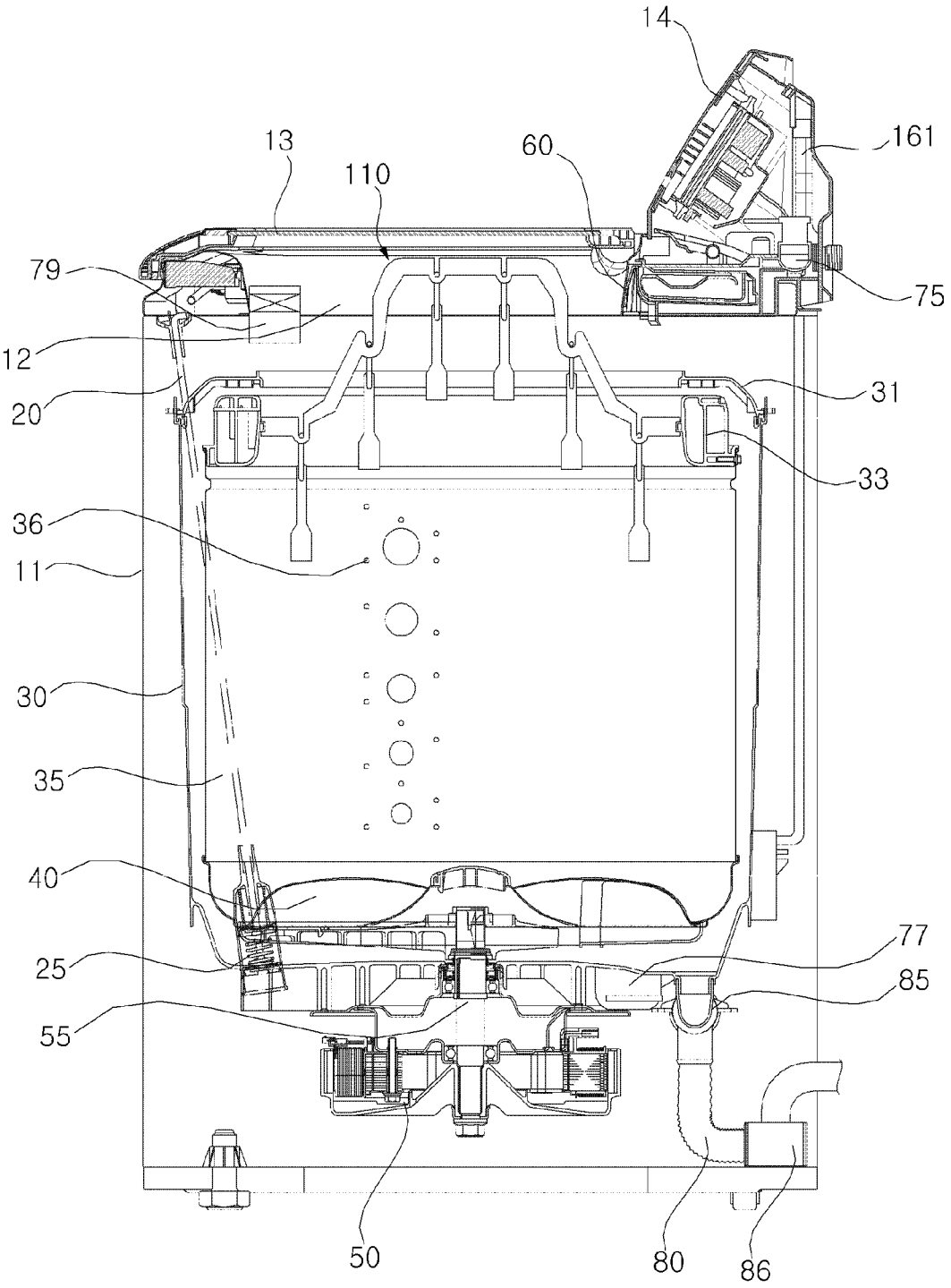
FIG. 1 is a side elevation view showing a washing machine according to an embodiment of the present invention.

FIG. 1 is a side elevation view showing a washing machine according to an embodiment of the present invention.

The washing machine according to the embodiment of the present invention includes an outer tub 30 for containing wash water, an inner tub 35 rotatably disposed in the outer tub 30, a hanger unit 110 detachably provided over the inner tub 35 for hanging laundry, a steam generator 77 disposed at the outer tub 30 to heat wash water so as to generate steam, and a drive unit 50, which rotates the inner tub 35 and thus the hanger unit 110 and introduces the steam generated by the steam generator 77 into the inner tub 35.

A cabinet 11 defines the appearance of the washing machine. The cabinet 11 preferably has an open upper end. The cabinet 11 is provided at the upper end thereof with a top cover 12, which is coupled thereto and has a laundry introduction port through which laundry is put thereinto or taken out therefrom.

The top cover 12 includes a door 13 for opening or closing the laundry introduction port and a control panel 14 which allows a user to input various control commands for the overall operation of the washing machine and displays the state of operation of the washing machine. The control panel 14 is preferably disposed behind the top cover 12.

A detergent box 60, which is adapted to contain various washing additives, such as a washing detergent, a rinsing fabric softener and/or a bleaching agent, is withdrawably mounted on the top cover 12.

A water supply channel is connected to an external water source such as a faucet so as to supply wash water to the washing machine. The water supply channel 61 is provided with a water supply valve 75 for controlling the supply of wash water. Upon opening of the water supply valve 75, the wash water supplied from the external water source is supplied to the inner tub 35 and/or the outer tub 30 via the water supply channel 61 and the detergent box 60.

Accordingly, it is possible to control the amount of wash water supplied from the external water source by controlling the time periods during which the water supply valve 75 is open and closed. The water supply valve 75 is capable of supplying a small amount of wash water by intermittent opening/closing thereof.

The outer tub 30 is disposed in the cabinet 11 to contain wash water. The outer tub 30 is configured to have a cylindrical shape having an open upper end. The inner tub 35 is disposed in the outer tub 30. The outer tub 30 is hung on the top cover by means of support members 220. Dampers 25 are connected between the support members 20 and the outer tub 30 to absorb vibrations generated during the operation of the washing machine. The outer tub 30 is provided at the upper end thereof with an outer tub cover 31. The outer tub cover 31 is coupled to the upper end of the outer tub 30, and has a center hole so as to allow laundry and/or wash water to pass therethrough.

A water discharge channel 80 is connected to the outer tub 30 so as to discharge wash water to the outside. The water discharge channel 80 is provided with a water discharge valve 85 for allowing or blocking the discharge wash water and a pump 86 for forcibly pumping wash water to be discharged to the outside.

The outer tub 30 is provided on the bottom surface thereof with the steam generator 77 for heating wash water to generate steam. The steam generator 77 serves to contain wash water therein and to heat the wash water so as to generate steam. The steam generated by the steam generator 77 is introduced into the outer tub 30, and the steam in the outer tub 30 is introduced into the inner tub 35 while the inner tub 35 is rotated by the drive unit 50.

The inner tub 35 is rotatably provided in the outer tub 30. The inner tub 35 is configured to have a cylindrical shape having an open upper end so as to allow laundry to be introduced therethrough. The inner tub 35 has formed in the side surface thereof a plurality of through holes 36 for allowing wash water and/or steam to flow between the inner tub 35 and the outer tub 30.

A pulsator 40 is rotatably provided at a lower position in the inner tub 35. The inner tub 35 is provided thereover with the hanger unit 110 on which laundry is hung.

The inner tub 35 includes a balancer 33 provided at an upper portion thereof. The balancer 33 serves to suppress the eccentric rotation of the inner tub 35. Laundry contained in the inner tub 35 may be tangled and thus concentrated at one side thereof with the result that the eccentric condition in which the weight of the laundry is loaded only at one side with respect to the rotational center of the inner tub 35, may occur. When the inner tub rotates while laundry is eccentrically concentrated, vibrations and noise are generated due to the imbalance, in which there is a difference between the geometrical rotational center and the center of gravity of the inner tub 35. The balancer 33 serves to attenuate the imbalance of the inner tub 35. The balancer 33 contains solid objects such as balls or fluid therein. The balancer 33 is configured to have an annular shape.

The drive unit 50 supplies driving force to the inner tub 35 and/or the pulsator 40 so as to rotate the inner tub 35 and/or the pulsator 40. The drive unit 50 is preferably embodied as a motor capable of generating a rotational force.

The rotational force generated by the drive unit 50 is transmitted to the inner tub 345 and/or the pulsator 40 through a rotating shaft 55. In order to rotate the inner tub 35 and the pulsator 40 concurrently or selectively, a clutch 37 may be provided so as to engage or disengage the connection between the rotating shaft 55 and the inner tub 35 or between the rotating shaft 55 and the pulsator 50.

The drive unit 50 rotates the inner tub 35 such that the steam generated by the steam generator 77 is introduced into the inner tub 35. The drive unit 50 rotates the inner tub 35 and in turn rotates the hanger unit 110. When the hanger unit 110 is rotated by the drive unit 50, the laundry hung on the hanger unit 110 is spread while being rotated. In other words, the drive unit 50 rotates the inner tub 35 so as to spread the laundry hung on the hanger unit 110.

A dryer 79 serves to heat air and to then supply the heated air to the inside of the inner tub 35. The dryer 79 is preferably provided at the top cover 12. The dryer 79 serves to introduce external air outside of the cabinet 11 into the cabinet 11 and to heat the external air, or serves to heat the air inside the cabinet 11. The dryer 79 supplies the heated air to the laundry hung on the hanger unit 110 to dry the laundry or to eliminate odors.

The hanger unit 110 serves to support laundry hung thereon. The hanger unit 110 causes the laundry hung thereon to be suspended in the direction of gravity in the inner tub 35.

The hanger unit 110 is detachably mounted on the upper portion of the inner tub 35. In this embodiment, the hanger unit 110 is detachably coupled to the balancer 33 disposed at an upper portion of the inner tub 35. In some embodiments, the hanger unit 110 may be detachably coupled to an upper portion of the inner tub 35.

The hanger unit 110 is configured to have an arch shape protruding upward. The hanger unit 110, which is arched, is preferably constructed in such a manner as to minimize contact between the lower end of laundry and the lower surface of the inner tub 35 while minimizing interference of the laundry with the top cover 12, the detergent boxy 60, the dryer 79, and the like.

The hanger unit 110 will now be described in detail with reference to FIG. 2.

Figure 2:
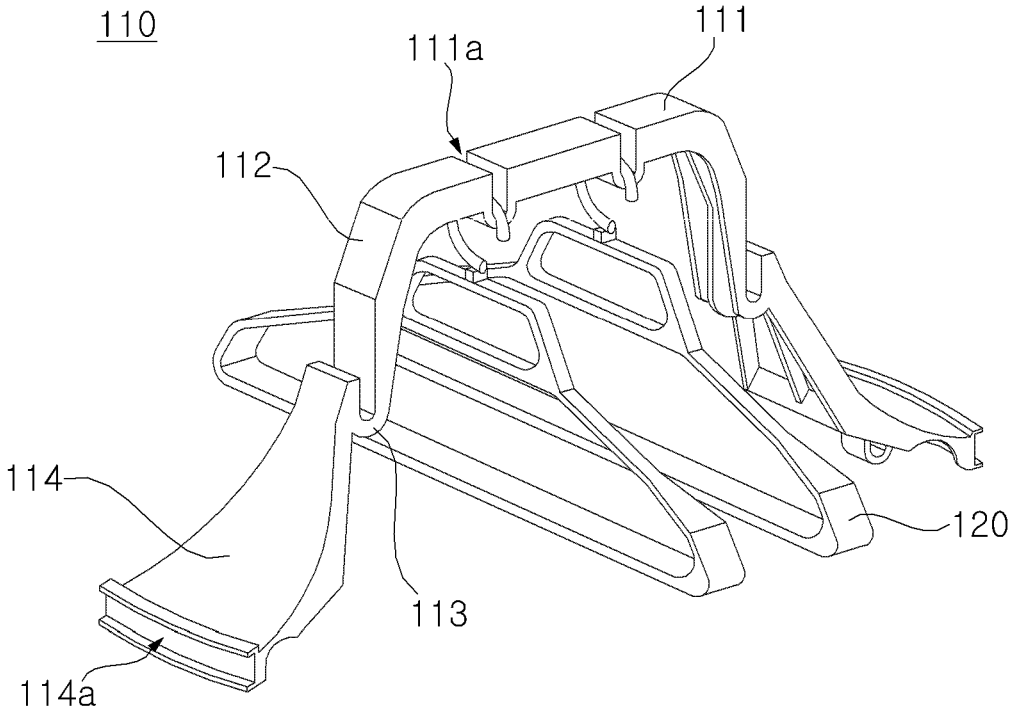
FIG. 2 is a perspective view showing the hanger unit of the washing machine according to the embodiment of the present invention.

FIG. 2 is a perspective view showing the hanger unit of the washing machine according to the embodiment of the present invention.

The hanger unit 110 according to the embodiment of the present invention includes a bar-shaped central section 111, which is disposed horizontally and has hanger grooves 111*a* with which hooks of hangers are engaged, a plurality of bar-shaped support sections 112 disposed vertically to support opposite ends of the central section 111, and a plurality of coupling sections 114, which are respectively connected to the plurality of support sections 112, and include respective coupling protrusions 114*a* to be coupled to the balancer 33.

It is preferable that the central section 111 and the support sections 112 be detachably coupled to each other such that the hanger unit 110 may be used with inner tubs 35 and/or balancers 33 having various sizes merely by replacing the central section 111. It is also preferable that the support sections 112 and the coupling sections 114 be integrally constructed.

The hanger unit 110 according to the embodiment of the present invention includes bent portions 113 exerting tensile force such that the hanger unit 110 is detachably mounted. Each of the bent portions 113 is configured to have a "U" shape so as to exert a tensile force horizontally.

The bent portions 113 may be formed at one of the central section 111, the support sections 112 and the coupling sections, or may be formed therebetween. In this embodiment, the bent portions 113 are formed between the support sections 112 and the coupling sections 114. The bent portions 113 may serve as hanger grooves similar to the hanger grooves 111*a*, with which the hangers 120 are engaged.

The hangers 120 may be included in the hanger unit 110, or may be independently provided. The hangers 120 function to cause laundry hung thereon to be suspended in the direction of gravity.

Figure 3:
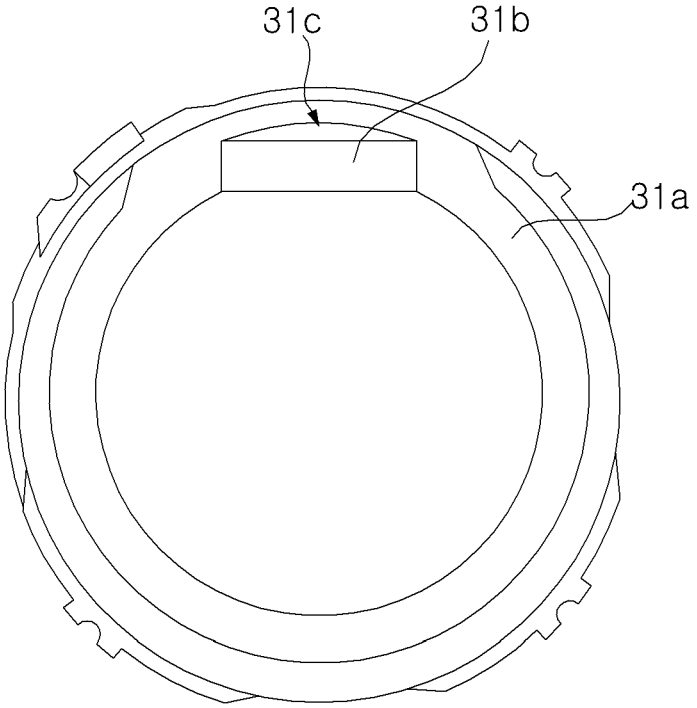
FIG. 3 is a plan view showing the outer tub cover of the washing machine according to the embodiment of the present invention.
Figure 4:
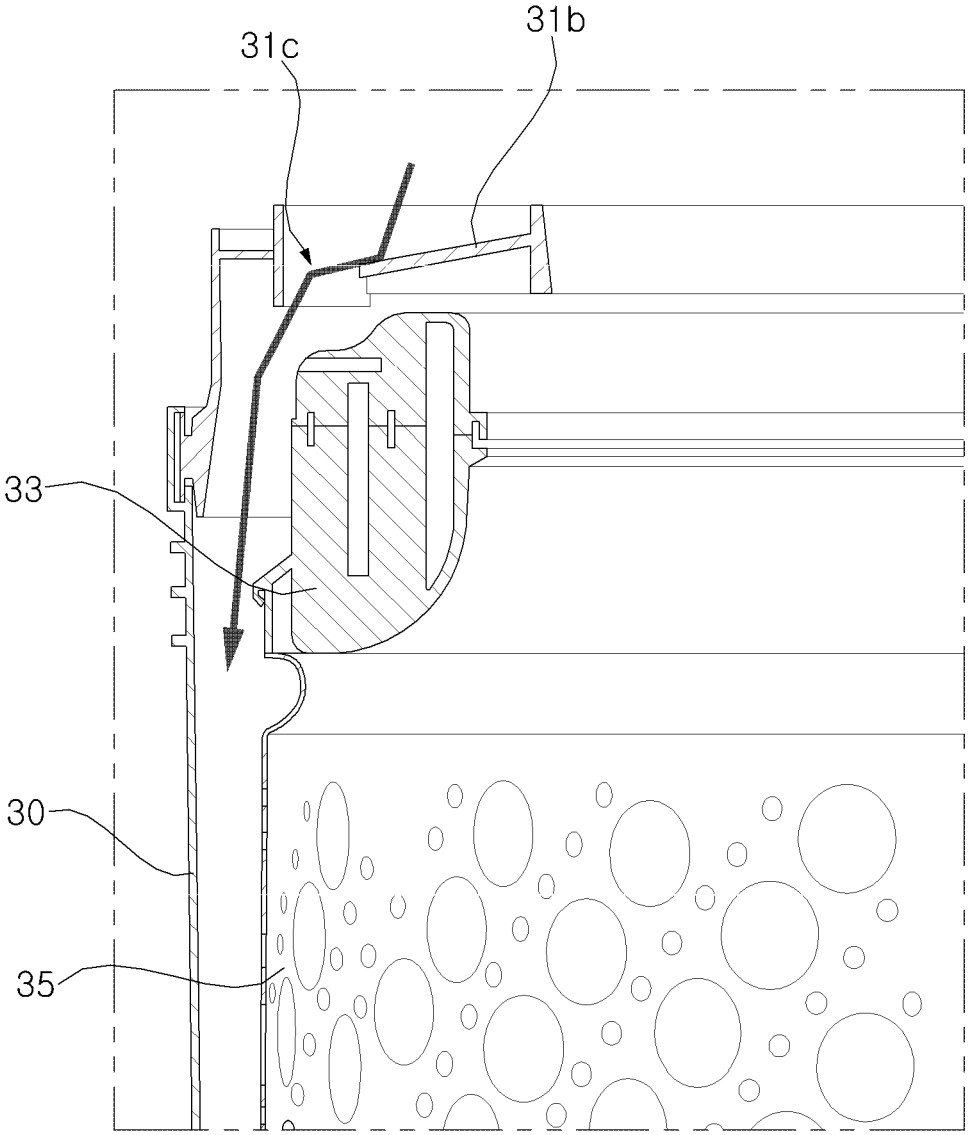
FIG. 4 is a partial cross-sectional view showing the outer tub cover shown in FIG. 3.

FIG. 3 is a plan view showing the outer tub cover of the washing machine according to the embodiment of the present invention. FIG. 4 is a partial cross-sectional view showing the outer tub cover shown in FIG. 3.

The outer tub cover 31 according to the embodiment of the present invention includes an annular cover body 31*a* coupled to an upper portion of the outer tub 30 and a wash water guide 31*b* for introducing wash water between the side surface of the outer tub 300 and the side surface of the inner tub 35.

The wash water guide 31*b* is formed so as to cross a part of the circumference of the cover body 31*a*. The wash water guide 31*b* is disposed under the detergent box 60. A wash water introduction hole 31*c* is defined between the cover body 31*a* and the wash water guide 31*b* so as to allow wash water to be introduced thereinto.

The wash water guide 31*b* is inclined toward the wash water introduction hole 31*c* and downward such that the wash water falling down from the detergent box 60 is introduced into the wash water introduction hole 31*c*. The wash water introduction hole 31*c* is disposed at an appropriate position such that the wash water is introduced between the side surface of the outer tub 30 and the balancer 33 and between the side surface of the outer tub 30 and the side surface of the inner tub 35.

When the wash water discharged from the detergent box 60 falls onto the wash water guide 31*b*, the wash water guide 31*b* guides the wash water into the wash water introduction hole 31*c* so as to introduce the wash water between the side surface of the outer tub 30 and the balancer 33 and between the side surface of the outer tub 30 and the side surface of the inner tub 35.

When the wash water is introduced between the side surface of the outer tub 30 and the side surface of the inner tub 35, the inner tub 35 is preferably rotated by the drive unit 50. The drive unit 50 rotates the inner tub 35 such that the wash water guide 31*b* makes the wash water flow in the downward direction of the outer tub 30 between the side surface of the outer tub 30 and the side surface of the inner tub 35. At this point, the drive unit 50 rotates the inner tub 35 at as low a controllable rotational speed as possible. In this embodiment, the drive unit 50 rotates the inner tub 35 at a rotational speed of 10 RPM.

When the amount of wash water that is discharged from the detergent box 60 and then falls onto the wash water guide 31*b* is small, a water stream is created from the wash water guide 31*b* toward the inside of the inner tub 35 (in the direction opposite to the wash water introduction hole 31*c*), thus allowing the wash water to be introduced into the inside of the inner tub 35. Accordingly, the drive unit 50 rotates the inner tub 35 so as to cause the wash water, which is discharged from the detergent box 60 and falls onto the wash water guide 31*b*, to be drawn into the wash water introduction hole 31*c*.

The wash water, which has been introduced between the side surface of the outer tub 30 and the side surface of the inner tub 35, may be introduced into the inner tub 46 through the through holes 36. Hence, the drive unit 50 rotates the inner tub 35 so as to prevent the wash water flowing between the side surface of the outer tub 30 and the side surface of the inner tub 35 from being introduced into the through holes 36.

The water supply valve 75 serves to control the supply of wash water such that the wash water is introduced between the side surface of the outer tub 30 and the side surface of the inner tub 35. When a large amount of wash water is supplied from an external water source and a large amount of wash water is thus discharged from the detergent box 60, the wash water may be introduced into the inner tub 35 even when the wash water guide 31*b* fulfills its function normally. Hence, the water supply valve 75 is intermittently opened and closed so as to supply a relatively small amount of wash water and thus to discharge the relatively small amount of wash water from the detergent box 60.

The wash water, which is introduced between the side surface of the outer tub 30 and the side surface of the inner tub 35 by the wash water guide 31*b*, flows in the downward direction of the outer tub 30 and then flows into the steam generator 77. The steam generator 77 receives the wash water, which is introduced thereinto along the space between the side surface of the outer tub 30 and the side surface of the inner tub 35, and heats the wash water so as to generate steam.

Figure 5:
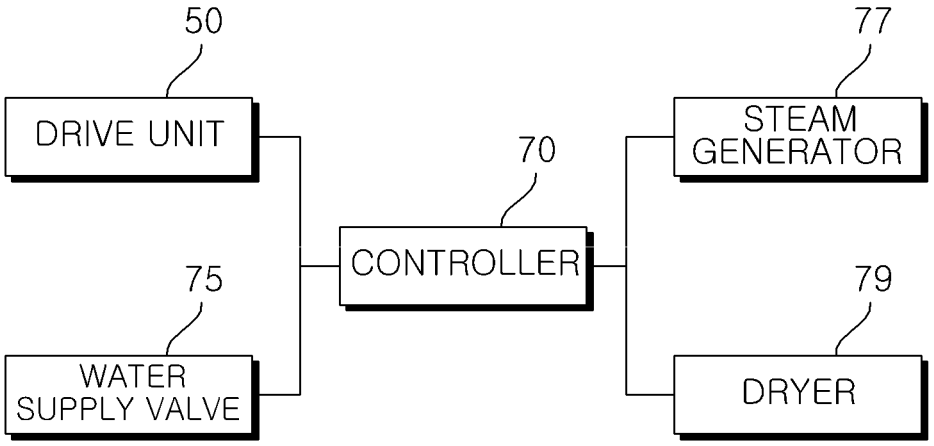
FIG. 5 is a block diagram of the washing machine according to the embodiment of the present invention.

FIG. 5 is a block diagram of the washing machine according to the embodiment of the present invention.

The washing machine according to the embodiment of the present invention includes a controller 70 that controls the drive unit 50, the water supply valve 75, the steam generator 77 and the dryer 79 in response to a command and/or setting input through the control panel 14.

The controller 70 controls the respective components of the washing machine to perform various courses or operations, and displays the state of operation of the washing machine on the control panel 14 so as to enable a user to view the state of operation from the outside.

When a user hangs laundry on the hanger unit 110, couples the hanger unit 110 to an upper portion of the inner tub 35, that is, the balancer 33, and selects a refresh course through the control panel 14, the controller 70 controls the drive unit 50, the water supply valve 75, the steam generator 77 and the dryer 79 so as to perform the refresh course.

The refresh course will be described in detail with reference to FIG. 6.

Figure 6:
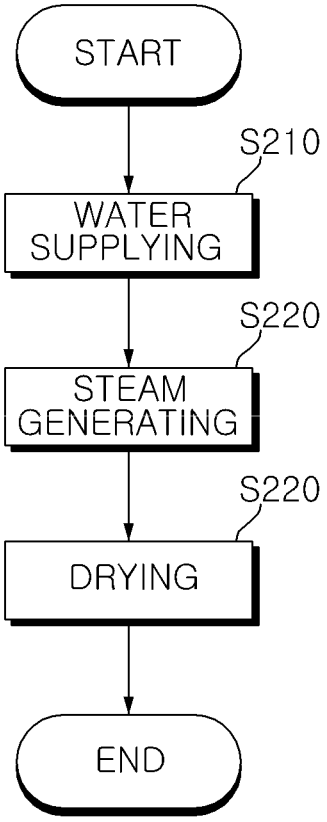
FIG. 6 is a flowchart illustrating a method of controlling the washing machine according to an embodiment of the present invention.

FIG. 6 is a flowchart illustrating a method of controlling the washing machine according to an embodiment of the present invention.

When a user hangs laundry on the hanger unit 110, couples the hanger unit 110 to an upper portion of the inner tub 35, that is, the balancer 33, and selects the refresh course through the control panel 14, the controller 70 performs a water supply operation (S210). During the water supply operation, the controller 70 controls the water supply valve 75 to allow wash water to be supplied from an external water source, and activates the drive unit 70 to rotate the inner tub 35.

When the controller 70 opens and closes the water supply valve 75 intermittently, a relatively small amount of wash water is supplied from the external water source. The wash water is introduced into the wash water guide 31*b* through the water supply channel 61 and the detergent box 60. Owing to the rotation of the inner tub 35, the wash water, which has been introduced into the wash water guide 31*b*, flows between the side surface of the outer tub 30 and the balancer 33 and between the side surface of the outer tub 30 and the side surface of the inner tub 35 through the wash water introduction hole 31*c*. The wash water, which has been introduced between the outer tub 30 and the inner tub 35, flows downward from the outer tub 30 along the space between the side surface of the outer tub 30 and the side surface of the inner tub 35, and then flows into the steam generator 77.

The controller 70 controls the water supply valve 75 to supply an amount of wash water that is appropriate for filling the steam generator 77. When the steam generator 77 is filled with the appropriate amount of wash water, the controller 70 shuts the water supply valve 75 and halts the operation of the drive unit 50.

Subsequently, the controller 70 performs a steam generating operation (S220). In the steam generating operation, the controller 70 activates the steam generator 77 to generate steam in the outer tub 30, and activates the drive unit 50 to rotate the inner tub 35 while introducing the steam into the inner tub 35.

Upon activation of the steam generator 77 by the controller 70, the steam generator 77 heats the wash water contained therein to generate steam. The steam generated from the steam generator 77 fills the outer tub 30.

When the outer tub 30 is sufficiently filled with the steam, the controller 70 halts the operation of the steam generator 77 and then activates the drive unit 50. The controller 70 controls the drive unit 50 in such a manner as to accelerate the rotation of the inner tub 35, maintain the rotational speed at a predetermined speed, and decrease the rotational speed. At this point, the drive unit 50 preferably accelerates the rotational speed of the inner tub 35 to a speed sufficient to spread the laundry while rotating it. In this embodiment, the drive unit 50 accelerates the rotational speed of the inner tub 35 to a speed of 130 RPM, maintains the rotational speed at the speed of 130 RPM, and decelerates the rotational speed.

When the inner tub 35 is accelerated, is maintained at a predetermined rotational speed and is decelerated, the steam in the outer tub 30 rises along the space between the side surface of the outer tub 30 and the side surface of the inner tub 35, and then flows into the inner tub 35.

The controller 70 controls the drive unit 50 to repeat the cycle of accelerating the inner tub, maintaining the rotational speed of the inner tub 35 at a predetermined speed and decelerating the rotational speed. Specifically, the controller 70 controls the drive unit 50 to repeat the acceleration and deceleration of the inner tub 35 such that the laundry hung on the hanger unit 110 is repeatedly spread and drooped while being rotated.

When the laundry is sufficiently affected by the steam, the controller 70 halts the operation of the drive unit 50.

Subsequently, the controller 70 performs a drying operation (S230). In the drying operation, the controller 70 activates the dryer 79 to dry the laundry. Upon activation of the dryer 79 by the controller 70, the dryer 79 heats air and supplies the heated air to the inside of the inner tub 35. According to this embodiment, the controller 70 activates the dryer 70, and activates the drive unit 50 to rotate the inner tub 35. The controller 70 preferably controls the drive unit 50 to repeat acceleration and deceleration of the inner tub 35, similarly to the steam operating operation.

When the laundry is sufficiently dried, the controller 70 halts the operation of the dryer 79 and terminates the refresh operation.

The washing machine and the method of controlling the same according to the present invention provide at least one of the following effects.

First, steam is uniformly supplied to laundry thanks to the efficient generation and supply of steam.

Second, since steam is supplied to the inside of the inner tub by virtue of rotation of the inner tub, the washing machine is simplified and steam is uniformly supplied.

Third, since wash water is supplied in the downward direction of the outer tub through the side surfaces of the outer and inner tubs, the wash water cannot reach laundry disposed in the inner tub.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

an outer tub to contain wash water;

an inner tub rotatably disposed in the outer tub;

a hanger unit disposed over the inner tub on which laundry can be hung;

a steam generator disposed at the outer tub to heat the wash water so as to generate steam;

a drive unit to rotate the inner tub and in turn the hanger unit, and to introduce the steam generated from the steam generator into the inner tub; and a controller to control the steam generator and the drive unit, wherein the controller is configured to:

activate the steam generator to generate steam in the outer tub, and when the outer tub is filled with the steam, halt the operation of the steam generator and then activate the drive unit to rotate the inner tub.

2. The washing machine according to claim 1, wherein the drive unit is configured to rotate the inner tub such that laundry hung on the hanger unit can be spread.

3. The washing machine according to claim 2, wherein the drive unit is configured to repeatedly accelerate and decelerate the inner tub such that the laundry hung on the hanger unit can be repeatedly spread and drooped.

4. The washing machine according to claim 1, further comprising:

a balancer disposed at an upper portion of the inner tub to suppress an eccentric rotation of the inner tub, wherein the hanger unit is detachably coupled to the balancer.

5. The washing machine according to claim 1, wherein the hanger unit has an upward-protruding arch shape.

6. The washing machine according to claim 1, wherein the hanger unit includes a bent portion to exert a tensile force such that the hanger unit can be detachably mounted.

7. The washing machine according to claim 1, further comprising:

a water supply channel connected to an external water source to supply wash water; and an outer tub cover coupled to an upper portion of the outer tub and comprising a center opening, wherein the outer tub cover includes a wash water guide to introduce the wash water supplied through the water supply channel between a side surface of the outer tub and a side surface of the inner tub.

8. The washing machine according to claim 7, wherein when the wash water is introduced between the side surface of the outer tub and the side surface of the inner tub by the wash water guide, the drive unit rotates the inner tub.

9. The washing machine according to claim 8, wherein when the wash water is introduced between the side surface of the outer tub and the side surface of the inner tub, the drive unit rotates the inner tub at a rotational speed of 10 RPM.

10. The washing machine according to claim 7, wherein the water supply channel further comprises a water supply valve to control a supply of the wash water, wherein the water supply valve controls the wash water to be introduced between the side surface of the outer tub and the side surface of the inner tub.

11. The washing machine according to claim 10, wherein when the amount of wash water supplied through the water supply channel is large, the water supply valve is intermittently opened and closed so as to supply a relatively small amount of wash water.

12. The washing machine according to claim 7, wherein the steam generator receives the wash water which has been introduced between the side surface of the outer tub and the side surface of the inner tub by the wash water guide and heats the wash water to generate steam.

13. The washing machine according to claim 7, wherein when the amount of wash water supplied through the water supply channel is small, the drive unit rotates the inner tub to direct the wash water away from the inner tub and into a wash water introduction hole.

14. A method of controlling a washing machine including an outer tub to contain wash water, an inner tub rotatably disposed in the outer tub, and a hanger unit disposed over the inner tub on which laundry can be hung, the method comprising:

heating the wash water to generate steam in the outer tub; and rotating the inner tub so as to rotate the hanger unit and introduce the steam into the inner tub, wherein when the outer tub is filled with the steam, the heating of the wash water is stopped and then the inner tub starts to rotate.

15. The method according to claim 14, wherein, in the introducing of the steam, the inner tub is rotated so as to spread the laundry.

16. The method according to claim 14, wherein, in the introducing of the steam, the inner tub is accelerated, then maintained at a predetermined rotational speed, and then decelerated.

17. The method according to claim 16, wherein in the introducing of the steam, the inner tub is accelerated to a speed of 130 RPM, then maintained at a rotational speed of 130 RPM, and then decelerated.

18. The method according to claim 14, further comprising:

introducing the wash water between a side surface of the outer tub and a side surface of the inner tub, wherein the heating of the wash water to generate the steam is performed to heat the wash water introduced between the side surface of the outer tub and the side surface of the inner tub so as to generate the steam.

19. The method according to claim 18, wherein the inner tub is rotated during the introducing of the wash water.

* * * * *